United States Patent [19]

Allen et al.

[11] Patent Number: 4,653,646

[45] Date of Patent: Mar. 31, 1987

[54] SINGULAR PACKAGING SYSTEM FOR BASKETBALL RIM, BACKBOARD AND POLE

[75] Inventors: David A. Allen, New Berlin; John H. Miilu, Milwaukee, both of Wis.

[73] Assignee: Huffy Corporation, Milwaukee, Wis.

[21] Appl. No.: 820,243

[22] Filed: Jan. 17, 1986

[51] Int. Cl.[4] ..... B65D 69/00

[52] U.S. Cl. ..... 206/579; 206/315.1; 206/443; 206/449; 206/453; 206/491; 206/499; 206/586; 273/1.5 R

[58] Field of Search ..... 206/223, 315.1, 315.11, 206/317, 320, 321, 335, 443, 449, 451, 453, 491, 492, 499, 576, 579, 586; 273/1.5 R, 1.5 A

[56] References Cited

U.S. PATENT DOCUMENTS

| | | | |
|---|---|---|---|
| 1,504,292 | 8/1924 | Wickes | 206/320 |
| 1,667,887 | 5/1928 | Fallert | 206/320 |
| 1,669,169 | 5/1928 | Moss | 206/320 |
| 1,906,622 | 5/1933 | Kondolf | 229/165 |
| 2,594,628 | 4/1952 | Evans | 206/491 |
| 2,791,363 | 5/1957 | Boeye | 206/491 |
| 3,027,061 | 3/1962 | Locke | 206/491 |
| 3,497,057 | 2/1970 | Traner et al. | 206/499 |
| 3,780,933 | 12/1973 | Freeman | 229/40 |
| 3,896,987 | 7/1975 | Soja | 206/315.11 |
| 3,929,225 | 12/1975 | Locke et al. | 206/335 |
| 3,949,932 | 4/1976 | Shore | 229/40 |
| 4,170,297 | 10/1979 | Johnson | 206/499 |
| 4,197,788 | 4/1980 | Wharton, Jr. | 206/315.1 |
| 4,349,105 | 9/1982 | Bradley et al. | 206/317 |
| 4,469,224 | 9/1984 | Ritter | 206/335 |

*Primary Examiner*—Joseph Man-Fu Moy
*Assistant Examiner*—David T. Fidei
*Attorney, Agent, or Firm*—Andrus, Sceales, Starke & Sawall

[57] ABSTRACT

A packaging and shipping assembly (12) is provided for a basketball rim (4), backboard (6), pole (8) and extension arm (10) all in one relatively flat outer carton (14) having a length and width approximately the same as the backboard (6). The pole is provided in three sections (16, 18 and 20). A first subassembly (40, 42) retains two of the pole sections (16 and 20) side-by-side in parallel along one side of the outer carton (14). A second subassembly retains the third pole section (18) and the extension arm (10) side-by-side in parallel along the opposite side of the outer carton (14). A third subassembly retains the rim (4) and mounting hardware within the outer carton (14) between the other two subassemblies. The backboard (6) lies flat over the subassemblies within the outer carton (14).

19 Claims, 10 Drawing Figures

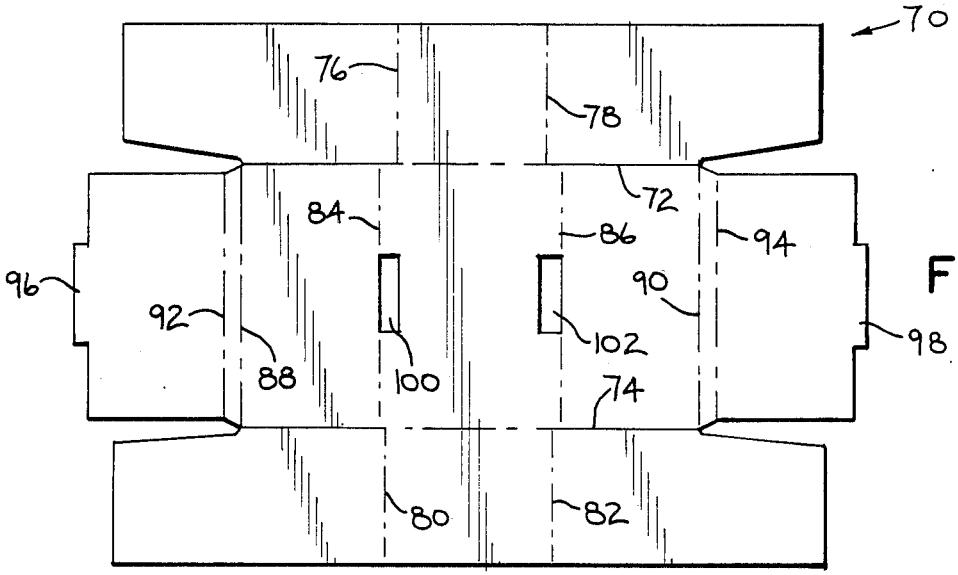
FIG. 5
FIG. 6
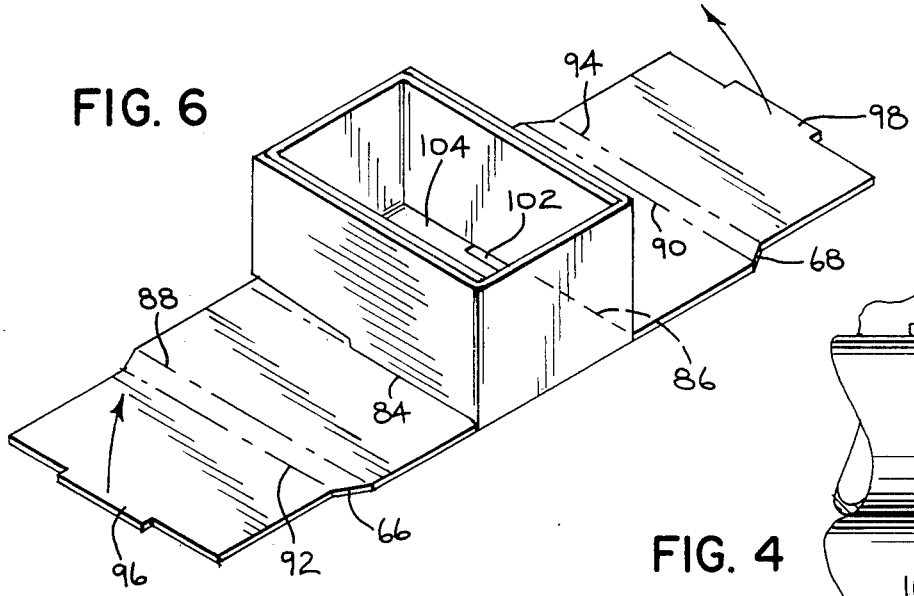
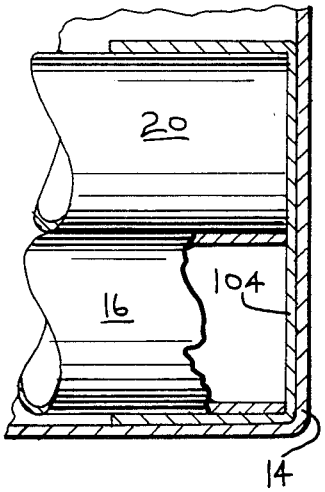
FIG. 4
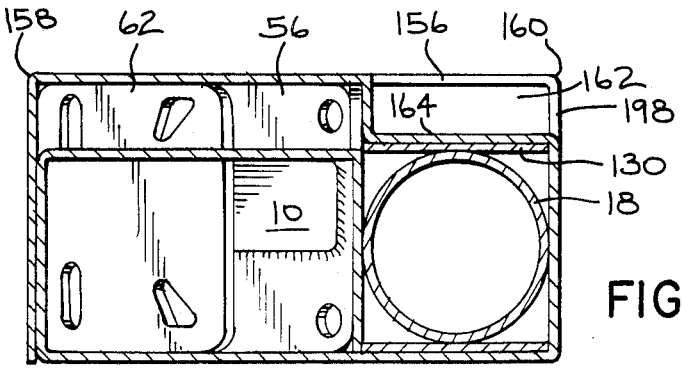
FIG. 8

SINGULAR PACKAGING SYSTEM FOR BASKETBALL RIM, BACKBOARD AND POLE

BACKGROUND AND SUMMARY

The invention relates to a packaging system for shipping a basketball rim, backboard and pole, all in one relatively flat container.

Prior packaging systems for basketball assemblies typically package the rim and backboard in one container, and the pole in another container. This requires shipment and handling of two separate items, and also requires the retailer to stock two separate items, as well as requiring the consumer to carry home two separate packages.

There is a need for a simple, cost effective packaging and shipping assembly eliminating the need for two separate containers. The cost savings from a shipping standpoint alone are significant. Furthermore, the retailer need only stock a single type item which is entirely self-contained. Furthermore, the consumer need only purchase and carry home a singular container.

The present invention provides a complete basketball assembly within a singular flat container, including all mounting hardware. The invention includes various advantageous packaging features preventing shifting of components and protecting components from one another, and enabling a cost effective subassembly packing system for preassembly in modular form prior to insertion into the final container.

BRIEF DESCRIPTION OF THE DRAWINGS

FIG. 4 is a sectional view taken along line 4—4 of FIG. 3.

FIG. 5 is a top plan view of the protective end cap of FIG. 3 in its flat prefolded condition.

FIG. 6 is a perspective view of the end cap of FIG. 4 in a partially folded condition.

FIG. 8 is a sectional view taken along line 8—8 of FIG. 3.

DETAILED DESCRIPTION

Figure 1:
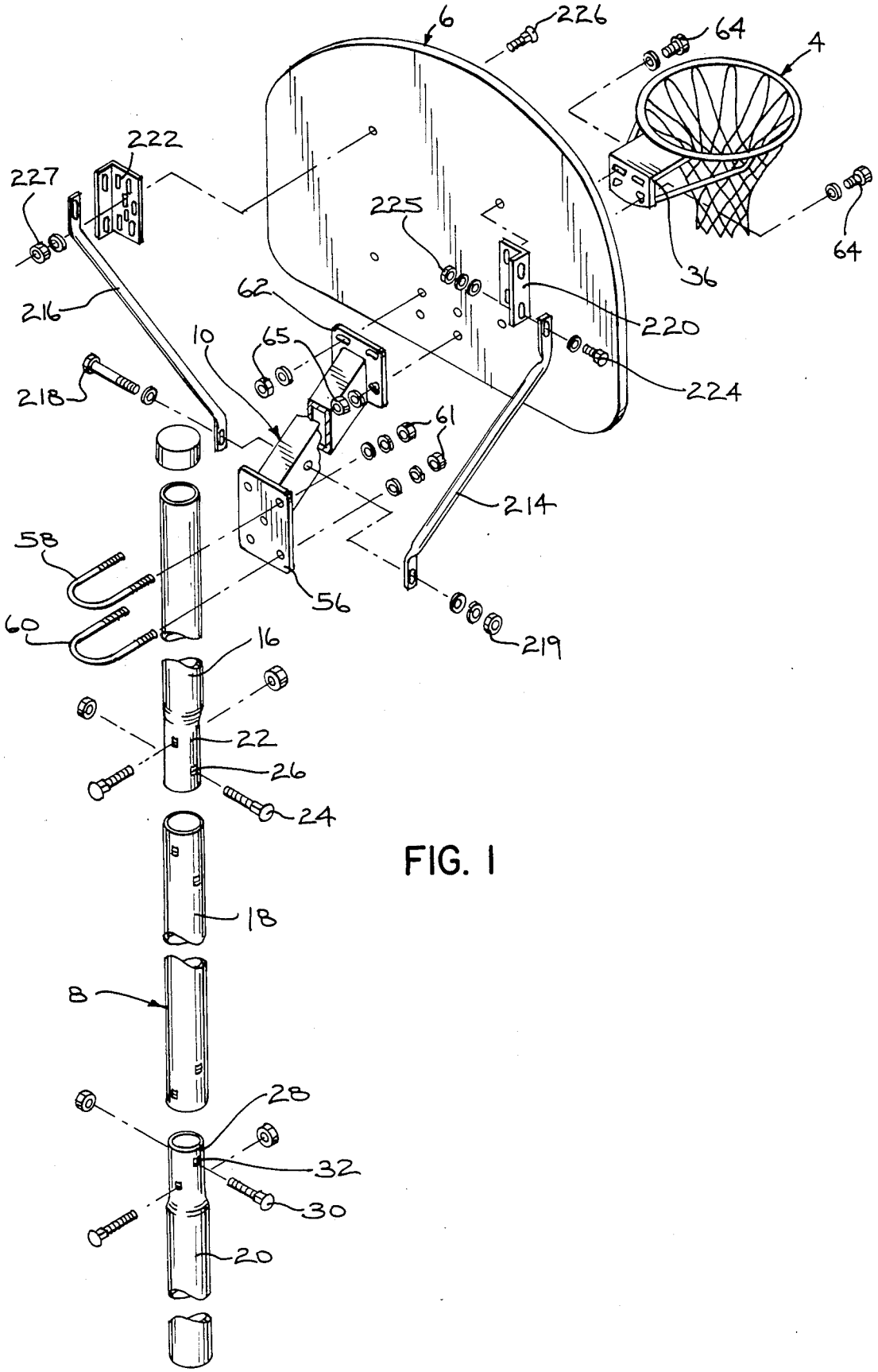
FIG. 1 is an exploded perspective view of a basketball rim, backboard and pole as assembled by the user.
Figure 2:
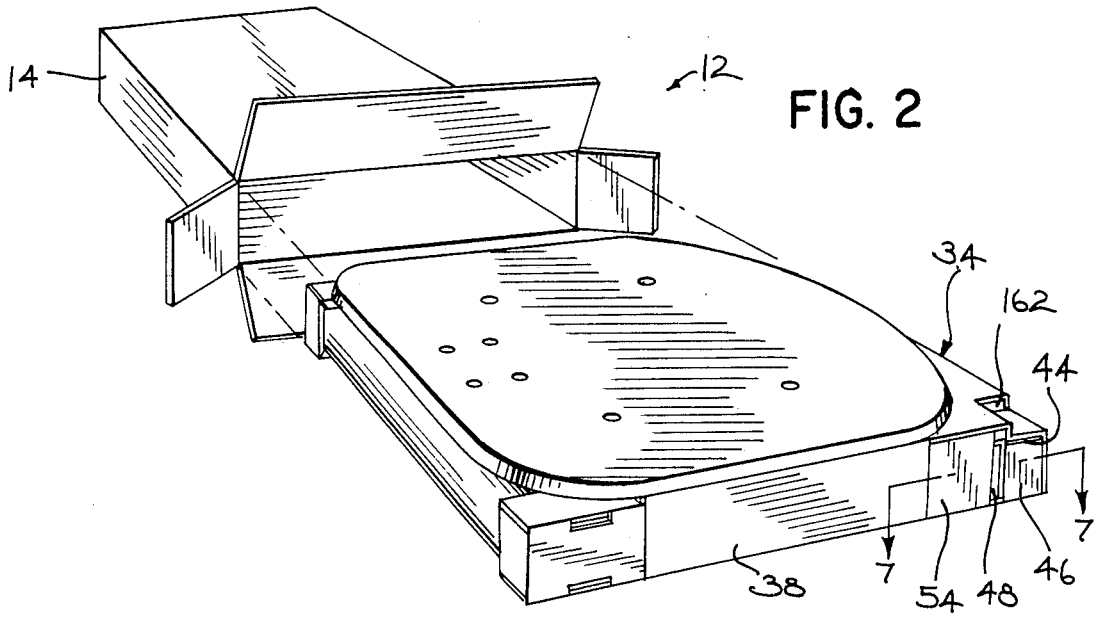
FIG. 2 is a perspective view of a packaging and shipping assembly for the basketball rim, backboard, pole, extension arm and hardware of FIG. 1 all in one relatively flat container.

FIG. 1 shows a basketball rim 4, backboard 6, pole 8, extension arm 10, and various mounting hardware. FIG. 2 shows a packaging and shipping assembly 12 for the basketball rim, backboard, pole, extension arm and hardware of FIG. 1 all in one relatively flat container or outer carton 14.

Pole 8 is divided into three sections 16, 18 and 20, FIG. 1. Upper pole section 16 is swedged to a reduced diameter at its lower end 22 for being telescopically received within the upper end of central pole section 18 and secured thereto by bolts such as 24 extending through aligned apertures such as 26. Lower pole section 20 is swedged to a reduced diameter at its upper end 28 for being telescopically received within the lower end of central pole section 18 and is mounted thereto by bolts such as 30 extending through aligned apertures such as 32. For shipping, the upper and lower pole sections 16 and 20 are packaged side-by-side in parallel along one longitudinal side of outer carton 14, with respective swedged sections 22 and 28 at opposite ends. Central pole section 18 and extension arm 10 are mounted side-by-side in parallel along the other longitudinal side of outer carton 14 by subassembly 34. Rim 4 includes inverted L-shaped mounting bracket 36 and is packaged within central box 38.

As will be described in detail, subassembly 34, central box 38 and protective end caps 40 and 42 for the pole sections cooperate to retain the pole sections, extension arm and rim within the outer container and prevent shifting movement of these components. Backboard 6 lies flat over central rim containing box 38. The top of the backboard rests on subassembly 34 and the bottom outer sides of the backboard rest on end caps 40 and 42. This orientation is desired because if the backboard were turned 180°, the top of the backboard might otherwise be susceptible to downward tilting toward pole sections 16 and 20.

Figure 7:
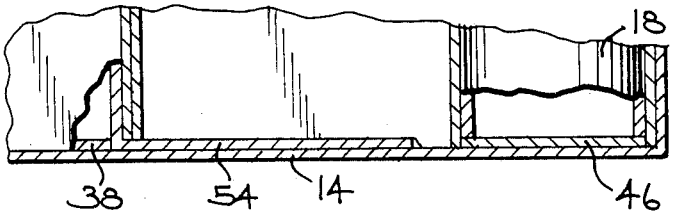
FIG. 7 is a sectional view taken along line 7—7 of FIG. 2.

Central rim-containing box 38 spaces, separates and prevents laterally inward movement of the two pole sections 16 and 20 on one side and the third pole section 18 and extension arm 10 on the other side. End cap members 40 and 42 provide a subassembly around the ends of pole sections 16 and 20 to protect the ends of outer carton 14 from cookie-cutter effect puncturing from the ends of the two pole sections 16 and 20. Subassembly 34 on the other side of the outer container includes a first chamber 44, FIGS. 2, 3 and 10, for securing the third pole section 18 and having end cap portions such as 46 protecting the ends of outer carton 14 from cookie-cutter effect puncturing from the ends of third pole section 18. Subassembly 34 has a second chamber 48 with detents provided by apertures 50 and 52, FIG. 10, engaging and securing extension arm 10. Central box 38 is wedged between subassembly 34 and one or the other of end caps 40 and 42. Central box 38 includes a flap 54, FIGS. 2, 3 and 7, folded outwardly away from box 38 and trapped between the end of outer carton 14 and subassembly 34 to prevent longitudinal shifting of central box 38.

Extension arm 10 connects and supports backboard 6 from top pole piece section 16, FIG. 1. Extension arm 10 includes a first mounting plate 56 at its lower end for mounting to upper pole section 16 by means of U-bolts 58 and 60 and nuts such as 61. The extension arm has a second mounting plate 62 at its upper end for mounting to backboard 6 and L-bracket 36 by means of bolts such as 64 and nuts 65. Mounting plates 56 and 62 are wider than the diameter of the pole. Extension arm 10 lays flat on its side in outer carton 14 such that the mounting plates 56 and 62 extend upwardly along their width above the pole sections, FIG. 8. End caps 40 and 42 have portions such as 66 and 68, FIGS. 3 and 6, extending away from and beyond the outer diameter of pole sections 16 and 20 to a given height. Subassembly 34 has a height substantially equal to the given height, such that backboard 6 rests on equal height subassemblies provided by the subassembly module 34 and the subassembly provided by end caps 40 and 42 within outer carton 14.

Figure 3:
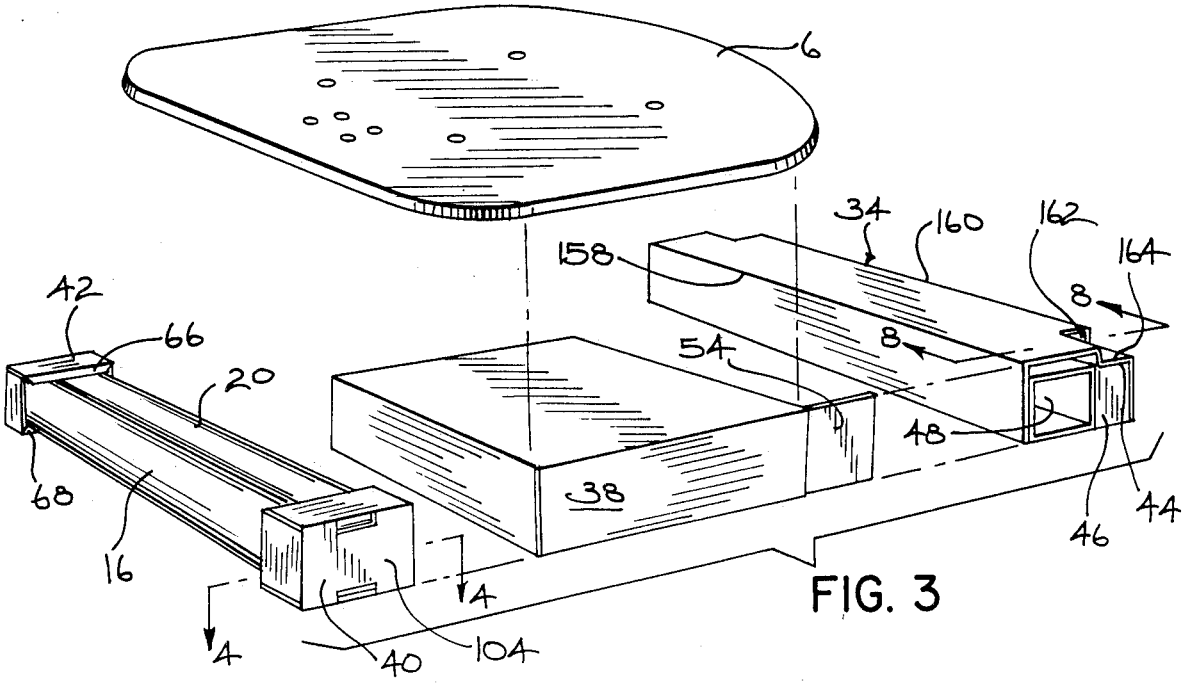
FIG. 3 is an exploded perspective view of the contents of FIG. 2.

As shown in FIGS. 2 and 3, each of the subassemblies retaining and supporting the two pole sections on the one side, the third pole section and extension arm on the other side, and the rim in the middle, have the same height and each supports the backboard lying thereon. Outer carton 14 has a length and width approximately the same as the backboard. The height of the outer carton is approximately equal to the thickness of the backboard plus the width of the widest mounting plate 56 or 62, if different, of extension arm 10.

End caps 40 and 42 provide a subassembly unit or module for pole sections 16 and 20 for stacking on a pallet or the like for later insertion into carton 14. Subassembly 34, mounting third pole section 18 and extension arm 10, likewise provides a subassembly unit or module for stacking on a pallet, for later insertion into carton 14. Central box 38 likewise provides a subassembly unit or module for insertion into carton 14 between the subassembly units on the opposite sides thereof. The carton is thus packed by inserting the various subassembly units or modules into the carton, with backboard 6 lying flat on the units.

End caps 40 and 42 are each formed by a corrugated blank folded to form an open box covering the ends of pole sections 16 and 20 and having a plurality of folded sections above and below the pole sections to provide an increased wall thickness, as at 66 and 68, above the bottom and below the top of outer carton 14. The plurality of folded sections forming the increased thickness walls at 66 and 68 have a combined thickness substantially equal to the difference in height between the diameter of the pole sections and the width of the widest mounting plate 56 or 62.

FIG. 5 shows the end cap blank 70 in its flat prefolded condition. The blank is a corrugated cardboard member. The blank is initially folded upwardly along fold lines 72 and 74 and then folded inwardly along fold lines 76, 78, 80 and 82, to the condition shown in FIG. 6. The blank is then folded upwardly along fold lines 84 and 86, and then inwardly along fold lines 88 and 90, and then downwardly along fold lines 92 and 94, with tabs 96 and 98 inserted into apertures 100 and 102, to yield the open boxes 40 and 42 as shown in FIG. 3. The end 104 of the box opposite the open end covers the ends of the pole sections and prevents cookie-cutter puncturing of the end of outer carton 14, FIG. 4.

Figure 9:
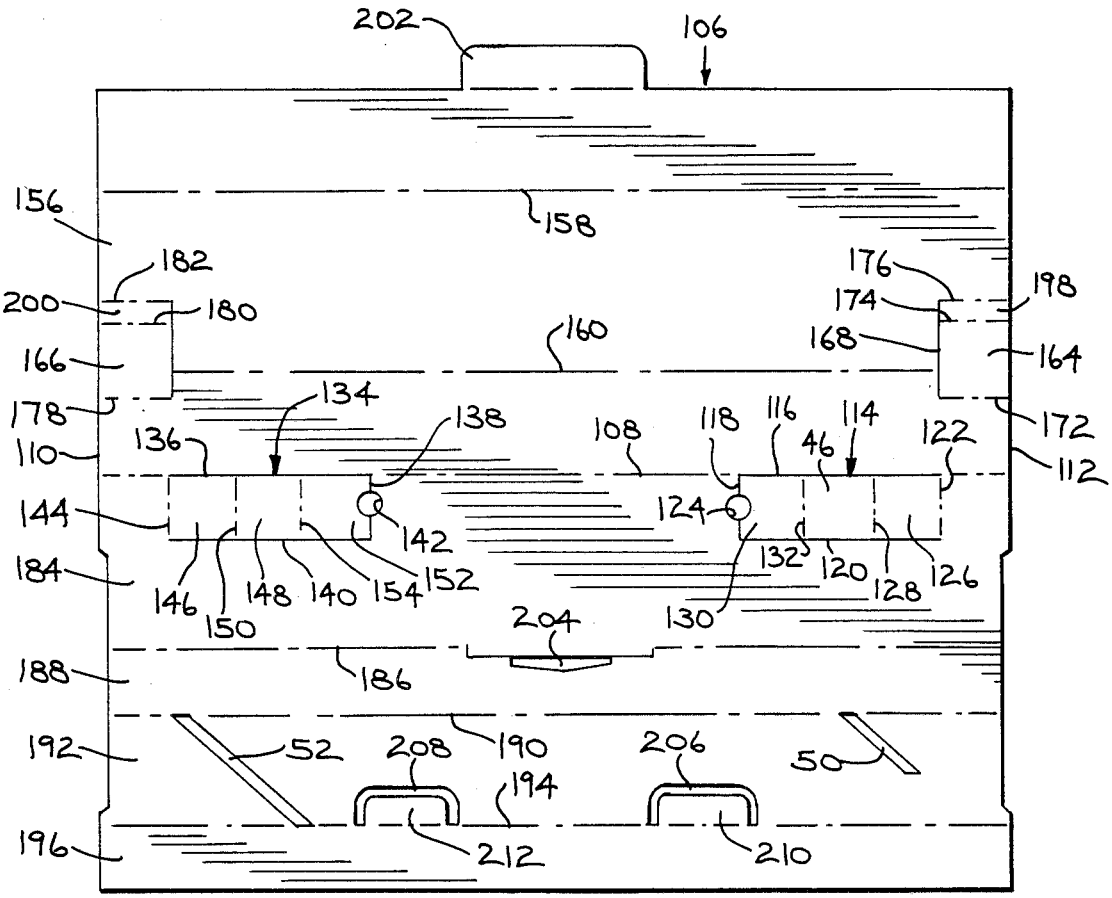
FIG. 9 is a top plan view of a subassembly of FIG. 3 in its flat prefolded condition.

Subassembly 34 is a corrugated blank 106, FIG. 9, folded over and retaining extension arm 10, and folded over and retaining third pole section 18. As viewed in FIG. 9, blank 106 has a longitudinal left-right axis parallel to third pole section 18 and folded along longitudinal left-right fold lines such as 108. The blank has left and right edges 110 and 112.

A first longitudinal flap 114 is cut from the blank along three sides 116, 118 and 120 of the flap and folded rightwardly along a lateral fold line 122 spaced leftwardly from the right edge 112 of the blank. The left cut line 118 includes a finger hole 124 therethrough. The flap 114 has a first portion 126 extending rightwardly from fold line 122 after the noted folding and extending beneath the right end of third pole section 18. Flap 114 has a second portion 46 folded upwardly from first portion 126 along a lateral fold line 128 substantially at the right edge 112 of the blank. Second flap portion 46 extends upwardly across the right end of pole section 18, FIGS. 2, 3, 7 and 10, and protects the end of outer carton 14 from cookie-cutter effect puncturing from pole section 18. Flap 114 has a third portion 130 folded leftwardly from second portion 46 along lateral fold line 132 and extending leftwardly over the right end of pole section 18.

A second longitudinal flap 134 is cut from blank 106 along three sides 136, 138 and 140 of the flap, with cut line 138 having a finger hole 142. Flap 134 is folded leftwardly along lateral fold line 144 spaced rightwardly from left edge 110 of the blank. Flap 134 has a first portion 146 extending leftwardly from fold line 144 after the noted folding and extending beneath the left end of pole section 18. Flap 134 has a second portion 148 folded upwardly from first portion 146 along lateral fold line 150 substantially at the left edge 110 of the blank. Second portion 148 extends upwardly across the left end of pole section 18. Flap 134 has a third portion 152 folded rightwardly from second portion 148 along lateral fold line 154 and extending rightwardly over the left end of third pole section 18.

Blank 106 includes a portion 156 folded along longitudinal fold lines 158 and 160 and spaced above pole section 18 by a gap 162, FIGS. 2, 3 and 8. This upper portion 156 of the blank has inverted sections 164 and 166 at its ends having lateral cut lines 168 and 170 and folded downwardly and inwardly along longitudinal fold lines 172, 174 and 176 for inverted section 164, and longitudinal fold lines 178, 180 and 182 for inverted section 166. Inverted sections 164 and 166 engage the top of flap portions 130 and 152 to further secure and retain the ends of pole section 18, FIGS. 3 and 8.

Figure 10:
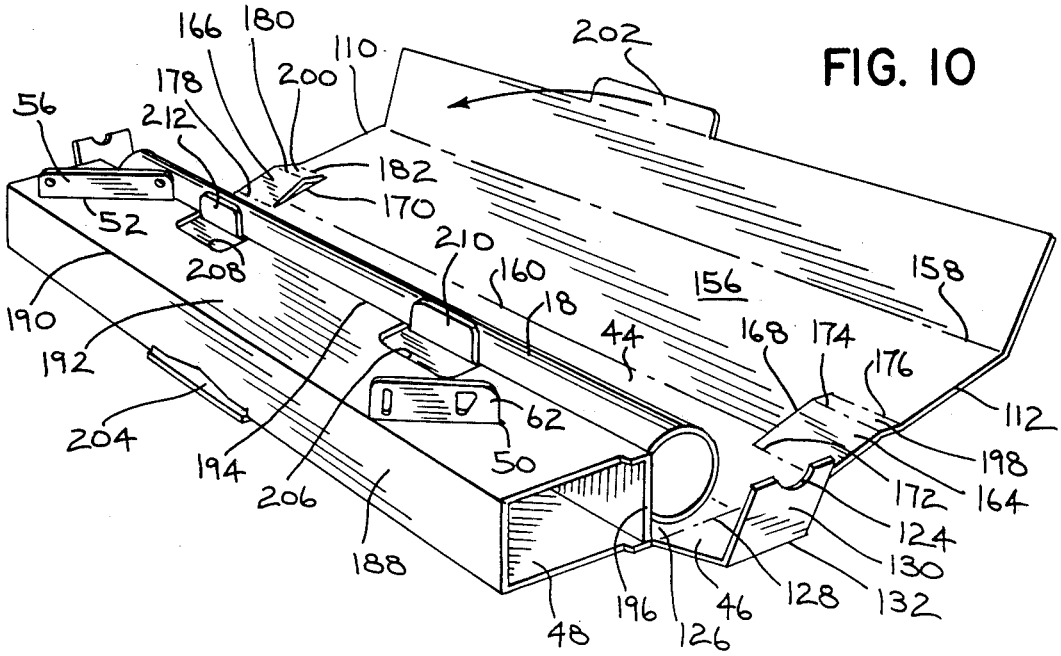
FIG. 10 is a perspective view of the subassembly of FIG. 8 in a partially folded condition.

Extension arm 10 is laid flat on its side on section 184 of blank 106, and the blank is folded upwardly along longitudinal fold line 186 to have an upstanding wall portion 188, FIG. 10, and then is folded inwardly along longitudinal fold line 190 to have an intermediate top section 192, with mounting brackets 56 and 62 extending upwardly through slot-like apertures 52 and 50, respectively. The blank is then folded downwardly along longitudinal fold line 194 to have a vertical dividing wall section 196 vertically extending between and dividing extension arm 10 and pole section 18. Blank 106 is then folded upwardly along longitudinal fold line 108 and then inwardly along longitudinal fold line 160 to provide top wall 156 spaced above intermediate top wall 92 by the height of gap 62 which is the vertical height of portions 198 and 200 of inverted sections 164 and 166. The blank is then folded over and around the portion of the blank which is folded around the extension arm. The blank is folded downwardly at longitudinal fold line 158, and tab 202 is inserted into aperture 204, to provide a self-contained modular type subassembly unit which may be stacked on a pallet for later insertion into outer carton 14.

Blank 106 has a pair of shallow U-shaped apertures 206 and 208 formed along the longitudinal fold line 194 forming the top of dividing wall 196. During the fold along line 194 the portions 210 and 212 in the center of each U are not folded but instead extend upwardly, FIG. 10, to form a pair of spacer and support tabs 210 and 212 engaging the underside of the blank portion 156 folded therearound. The top of the tabs is at substantially the same height as the top of the highest mounting plate 56 or 62.

All of the mounting hardware in FIG. 1 is contained within carton 14. A pair of support arms 214 and 216 are mounted at their lower ends to extension arm 10 by bolt 218 and nut 219 and at their upper ends to backboard 6 by L-brackets 220 and 222 and bolts such as 224 and 226 and nuts such as 225 and 227. Support arms 214 and 216 are packed inside third pole section 18 in subassembly 34. The various bolts and nuts and other mounting hardware are packed in central box 38 with rim 4.

It is recognized that various equivalents, alternatives and modifications are possible within the scope of the appended claims.

We claim:

1. A packaging and shipping assembly containing in combination a basketball rim, backboard and pole all in one relatively flat container, said backboard and rim being mountable to said pole at an elevated position for playing basketball, said assembly comprising:

an outer carton;

a plurality of pole sections assemblable to form said pole;

means retaining said pole sections within said outer carton and preventing shifting movement of said pole sections in said outer carton;

a circular rim including mounting bracket means for mounting to a backboard;

means retaining said rim within said outer carton and preventing shifting movement of said rim in said outer carton;

a backboard lying flat in said outer carton over said rim.

2. The invention according to claim 1 comprising extension arm means for connecting and supporting said backboard from one of said pole sections, and means retaining said extension arm means within said outer carton and preventing shifting movement of said extension arm means in said outer carton, said means retaining said pole sections, said extension arm means and said rim comprising modular subassembly packaging means insertable into said outer carton.

3. The invention according to claim 2 comprising two said pole sections mounted side-by-side in parallel along one longitudinal side of said outer carton, and a third said pole section and said extension arm means mounted side-by-side in parallel along the opposite longitudinal side of said outer carton, and wherein said rim is laterally between said two pole sections on one side and said third pole section and extension arm means on the other side.

4. The invention according to claim 3 wherein said means retaining said rim spaces, separates and prevents laterally inward movement of said two pole sections on one side and said third pole section and extension arm means on the other side.

5. The invention according to claim 3 comprising:

first subassembly means comprising end cap members around the ends of said two pole sections to protect the ends of said outer carton from cookie-cutter effect puncturing from the ends of said two pole sections;

second subassembly means including a first chamber for securing said third pole section and having end cap portions protecting the ends of said outer carton from cookie-cutter effect puncturing from the ends of said third pole section, said second subassembly means including a second chamber with detent means engaging and securing said extension arm means.

6. A packaging and shipping assembly containing in combination a basketball rim, backboard and pole all in one relatively flat container, said backboard and rim being mountable to said pole at an elevated position for playing basketball, said assembly comprising:

an outer carton;

a plurality of pole sections assemblable to form said pole;

means retaining said pole sections within said outer carton and preventing shifting movement of said pole sections in said outer carton;

a circular rim including mounting bracket means for mounting to a backboard;

means retaining said rim within said outer carton and preventing shifting movement of said rim in said outer carton;

a backboard lying flat in said outer carton over said rim;

extension arm means for connecting and supporting said backboard from one of said pole sections, and means retaining said extension arm means within said outer cartons and preventing shifting movement of said extension arm means in said outer carton;

two said pole sections mounted side-by-side in parallel along one longitudinal side of said outer carton, and a third said pole section and said extension arm means mounted side-by-side in parallel along the opposite longitudinal side of said outer carton, and wherein said rim is laterally between said two pole sections on one side and said third pole section and extension arms means on the other side;

first subassembly means comprising end cap members around the ends of said two pole sections to protect the ends of said outer carton from cookie-cutter effect puncturing from the ends of said two pole sections;

second subassembly means including a first chamber for securing said third pole section and having end cap portions protecting the ends of said outer carton from cookiecutter effect puncturing from the ends of said third pole section, said second subassembly means including a second chamber with detent means engaging and securing said extension arm means;

wherein said means retaining said rim comprises a central box wedged between said first and second subassembly means, and wherein said central box includes a flap folded outwardly away from said central box and trapped between one of said ends of said outer carton and one of said first and second subassembly means to prevent longitudinal shifting of said central box.

7. The invention according to claim 5 wherein:

said extension arm means includes a first mounting plate at one end for mounting to one of said pole sections, and a second mounting plate at the other end for mounting to said backboard;

at least one of said mounting plates has a width greater than the diameter of said pole sections;

said extension arm means lays flat on its side in said outer carton such that said one mounting plate extends upwardly along its width above said pole sections;

said first subassembly means end cap members have portions extending away from and beyond the outer diameter of said two pole sections to a given height;

said second subassembly means has a height substantially equal to said given height;

said backboard rests on said first and second equal height subassembly means within said outer carton.

8. A packaging and shipping assembly containing in combination a basketball rim, backboard and pole all in one relatively flat container, said backboard and rim being mountable to said pole at an elevated position for playing basketball, said assembly comprising:

an outer carton;

a plurality of pole sections assemblable to form said pole;

means retaining said pole sections within said outer carton and preventing shifting movement of said pole sections in said outer carton;

a circular rim including mounting bracket means for mounting to a backboard;

means retaining said rim within said outer carton and preventing shifting movement of said rim in said outer carton;

a backboard lying flat in said outer carton over said rim;

extension arm means for connecting and supporting said backboard from one of said pole sections, and means retaining said extension arm means within said outer cartons and preventing shifting movement of said extension arm means in said outer carton;

two said pole sections mounted side-by-side in parallel along one longitudinal side of said outer carton, and a third said pole section and said extension arm means mounted side-by-side in parallel along the opposite longitudinal side of said outer carton, and wherein said rim is laterally between said two pole sections on one side and said third pole section and extension arms means on the other side;

first subassembly means comprising end cap members around the ends of said two pole sections to protect the ends of said outer carton from cookie-cutter effect puncturing from the ends of said two pole sections;

second subassembly means including a first chamber for securing said third pole section and having end cap portions protecting the ends of said outer carton from cookie-cutter effect puncturing from the ends of said third pole section, said second subassembly means including a second chamber with detent means engaging and securing said extension arm means;

and wherein:

said extension arm means includes a first mounting plate at one end for mounting to one of said pole sections, and a second mounting plate at the other end for mounting to said backboard;

at least one of said mounting plates has a width greater than the diameter of said pole sections;

said extension arm means lays flat on its side in said outer carton such that said one mounting plate extends upwardly along its width above said pole sections;

said first subassembly means end cap members have portions extending away from and beyond the outer diameter of said two pole sections to a given height;

said second subassembly means has a height substantially equal to said given height;

said backboard rests on said first and second equal height subassembly means within said outer carton;

said second subassembly means comprises a folded box having a first section folded over said extension arm means and having a pair of slot-like apertures in said first section through which said first and second mounting plates extend for securing and retaining said extension arm means, said folded box having a second section folded around and over said third pole section.

9. The invention according to claim 8 wherein said second section of said folded box has a pair of flaps punched therethrough on three sides of said flaps and folded back on a fourth side to extend beneath said third pole section and then around the ends of said third pole section and then along the top of said third pole section and covered by the remainder of said second section of said box folded thereover.

10. A packaging and shipping assembly containing in combination a basketball rim, backboard, pole and extension arm all in one relatively flat outer carton having a length and width approximately the same as said backboard, said backboard, rim and extension arm being mountable to said pole at an elevated position for playing basketball, said assembly comprising:

an outer carton;

a plurality of pole sections assemblable to form said pole;

an extension arm for connecting and supporting said backboard and rim from one of said pole sections;

a circular rim;

modular subassembly means packaging and retaining said pole sections, said extension arm and said rim and insertable into said outer carton and preventing shifting movement of said pole sections, said extension arm and said rim in said outer carton;

a backboard lying flat in said outer carton over said modular subassembly means packaging and retaining said pole sections, said extension arm and said rim;

said backboard having a length longer than or equal to the length of any component in said outer carton, said backboard having a width wider than or equal to the width of any component in said outer carton, such that said backboard is the largest component in said outer carton, and said outer carton has a size substantially no larger than said backboard.

11. A packaging and shipping assembly containing in combination a basketball rim, backboard, pole and extension arm all in one relatively flat container, said backboard, rim and extension arm being mountable to said pole at an elevated position for playing basketball, said assembly comprising:

an outer carton;

three pole sections assemblable to form said pole;

first subassembly means for mounting two of said pole sections side-by-side in parallel as a first subassembly unit for insertion into said carton along one longitudinal side thereof;

second subassembly means for mounting a third said pole section and said extension arm side-by-side in parallel as a second subassembly unit for insertion into said carton along the other longitudinal side thereof opposite said one side;

third subassembly means for mounting said rim as a third subassembly unit for insertion into said carton between said first and second subassembly units, such that said carton is packed by inserting said first, second and third subassembly units into said carton, with said backboard lying flat on said units.

12. The invention according to claim 11 wherein said first subassembly means comprises a pair of corrugated end caps each formed by a corrugated blank folded to form an open box covering the ends of said two pole sections and having a plurality of folded sections above and below said two pole sections to provide an increased wall thickness for said box and spacing said two pole sections above the bottom and below the top of said outer carton.

13. The invention according to claim 12 wherein:

said extension arm means includes a first mounting plate at one end for mounting to one of said pole sections, and a second mounting plate at the other end for mounting to said backboard;

at least one of said mounting plates has a width greater than the diameter of said pole sections;

said extension arm lays flat on its side in said carton such that said one mounting plate extends upwardly along its width above said pole sections;

said plurality of folded sections forming said increased thickness walls of said open box end caps of said first subassembly unit have a combined thickness substantially equal to the difference in height between the diameter of said pole sections and said width of said one mounting plate.

14. The invention according to claim 11 wherein said second subassembly means comprises a corrugated blank folded over and retaining said extension arm, and folded over and retaining said third pole section.

15. A packaging and shipping assembly containing in combination a basketball rim, backboard, pole and extension arm all in one relatively flat container, said backboard, rim and extension arm being mountable to said pole at an elevated position for playing basketball, said assembly comprising:

an outer carton;

three pole sections assemblable to form said pole;

first subassembly means for mounting two of said pole sections side-by-side in parallel as a first subassembly unit for insertion into said carton along one longitudinal side thereof;

second subassembly means for mounting a third said pole section and said extension arm side-by-side in parallel as a second subassembly unit for insertion into said carton along the other longitudinal side thereof opposite side one side;

third subassembly means for mounting said rim as a third subassembly unit for insertion into said carton between said first and second subassembly units, such that said carton is packed by inserting said first, second and third subassembly units into said carton, with said backboard lying flat on said units;

wherein said second subassembly means comprises a corrugated blank folded over and retaining said extension arm, and folded over and retaining said third pole section;

wherein said blank has a longitudinal left-right axis parallel to said third pole section and is folded along longitudinal left-right fold lines, said blank having left and right edges, and comprising:

a first longitudinal flap cut from said blank along three sides of said flap and folded rightwardly along a lateral fold line spaced leftwardly from said right edge of said blank, said flap having a first portion extending rightwardly from said fold line and beneath the right end of said third pole section, said flap having a second portion folded upwardly from said first portion along a lateral fold line, said second portion extending upwardly across the right end of said third pole section, said flap having a third portion folded leftwardly from said second portion along a lateral fold line and extending leftwardly over said third pole section; and a second longitudinal flap cut from said blank along three sides of said second flap and folded leftwardly along a lateral fold line spaced rightwardly from said left edge of said blank, said second flap having a first portion extending leftwardly from said last mentioned fold line and beneath the left end of said third pole section, said second flap having a second portion folded upwardly from said first portion of said second flap along a lateral fold line, said second portion of said second flap extending upwardly across the left end of said third pole section, said second flap having a third portion folded rightwardly from said second portion of said second flap along a lateral fold line and extending rightwardly over said third pole section.

16. The invention according to claim 15 wherein said blank includes a top portion folded along one of said longitudinal fold lines and spaced above said third pole section by a gap, and wherein said last mentioned top portion of said blank has an inverted section at its right end folded downwardly to engage the top of said third portion of said first flap.

17. The invention according to claim 16 wherein said blank is folded along said longitudinal fold lines around said extension arm and includes a section extending vertically between and dividing said extension arm and said third pole section, and wherein said blank is folded over said third pole section and over and around the portion of said blank which is folded around said extension arm.

18. The invention according to claim 17 wherein:

said extension arm includes a first mounting plate at one end for mounting to one of said pole sections, and a second mounting plate at the other end for mounting to said backboard;

at least one of said mounting plates has a width greater than the diameter of said pole sections;

said extension arm lays flat on its side with said blank folded therearound such that said one mounting plate extends upwardly along its width above said third pole section;

said blank has a pair of slot-like apertures through which said mounting plates extend when said blank is folded around said extension arm.

19. The invention according to claim 18 wherein said blank has a pair of shallow U-shaped apertures formed along the longitudinal fold line forming the top of said dividing section between said extension arm and said third pole section such that during the fold along said last mentioned fold line the portion of the blank in the center of each U is not folded but instead extends upwardly to form a pair of spacer and support tabs engaging the underside of the blank portion folded therearound, the top of said tabs being approximately the same height as said one mounting plate.

* * * * *